United States Patent [19]

Löffler et al.

[11] Patent Number: 4,967,637

[45] Date of Patent: Nov. 6, 1990

[54] PROJECTILE ACCELERATING DEVICE

[75] Inventors: Markus Löffler, Unterlüss; Wolfram Witt, Dusseldorf, both of Fed. Rep. of Germany

[73] Assignees: Rheinmetall GmbH, Düsseldorf; TZN Forschumgs-und Entwicklungszentrum Unterluss GmbH, Unterluss, both of Fed. Rep. of Germany

[21] Appl. No.: 337,049

[22] Filed: Apr. 12, 1989

[30] Foreign Application Priority Data

Apr. 28, 1988 [DE] Fed. Rep. of Germany ..... 3814331

[51] Int. Cl.[5] ..... F41B 6/00

[52] U.S. Cl. ..... 89/1.816; 60/203.1; 89/8; 102/374

[58] Field of Search ..... 60/202, 203.1, 204; 89/7, 8, 1.8, 1.816, 1.817, 1.818; 102/374, 375

[56] References Cited

U.S. PATENT DOCUMENTS

| | | | |
|---|---|---|---|
| 2,468,134 | 4/1949 | Swipp | 89/1.816 |
| 2,783,684 | 3/1957 | Yoler | 89/7 |
| 2,899,864 | 8/1959 | Bloxsom, Jr. | 89/7 |
| 3,041,824 | 7/1962 | Berhman | 60/203.1 |
| 3,313,208 | 4/1967 | Dorsey et al. | 89/7 |
| 3,447,332 | 6/1969 | Mastrup | 60/203.1 |
| 3,610,095 | 10/1971 | Black et al. | 89/1.8 |
| 4,711,154 | 12/1987 | Chryssomallis et al. | 89/7 |
| 4,821,508 | 4/1989 | Burton et al. | 60/204 |

*Primary Examiner*—Stephen C. Bentley
*Attorney, Agent, or Firm*—Spencer & Frank

[57] ABSTRACT

A device for accelerating projectiles from a launching tube by means of an electrically heated plasma and two electrodes between which burns an electric arc so as to heat the plasma. To cause the pressure for accelerating the projectile in the launching tube to be as high as possible, the two electrodes and thus the electric arc which heats the plasma are disposed within a rear portion of the projectile.

4 Claims, 2 Drawing Sheets

1
2
3
4
5
6
11
12
41
42
43
44
45
46
47
48
61
62
63
64
COIL
ENERGY SUPPLY SYSTEM 1
2
3
4
5
7
8
11
12
41
42
43
44
45
46
61
62
63
64
i
u
COIL

PROJECTILE ACCELERATING DEVICE

BACKGROUND OF THE INVENTION

The present invention relates to a device for accelerating projectiles from a launching tube that is closed at one end, with a plasma produced and heated by an electric arc generated between a pair of electrodes.

U.S Pat. No. 2,899,864 discloses firing devices which operate according to the electrothermal principle. In such firing devices, the hot plasma required to drive the projectile is generated and heated with the aid of an electric arc between two fixed electrodes. The fixed electrodes are disposed at the closed (breechblock) end of the tube. Heating of the plasma by means of an arc between the electrodes produces a pressure which accelerates a projectile disposed in the tube. Because of the flow processes in the tube, it is not possible during acceleration of the projectile for the pressure generated in the immediate vicinity of the arc to also occur at the base of the projectile. The velocity of the projectile at the open end of the tube is noticeably less in this case than would be possible if it were accelerated by the pressure existing in the volume occupied by the electric arc.

SUMMARY OF THE INVENTION

It is therefore an object of the present invention to provide a device of the above-mentioned type with which it is possible to easily increase the pressure used to accelerate the projectile.

This is accomplished in accordance with the invention by providing a device for accelerating a projectile from a launching tube which is closed at one end, with an plasma electrically heated by an electric arc generated by and between two electrodes disposed one behind the other within, and aligned in the longitudinal direction of the tube, and the rear of the projectile is provided with an opening through which the heated plasma is able to exit into the region of the tube behind the projectile.

Thus, by this structure the drawbacks of the prior art firing devices are essentially overcome in that the volume containing the electric arc is within the projectile itself.

BRIEF DESCRIPTION OF THE DRAWINGS

These and other details and advantages of the invention can be more completely understood from the following detailed description of the preferred embodiments with reference to the accompanying drawings in which.

DESCRIPTION OF THE PREFERRED EMBODIMENTS

Figure 1:
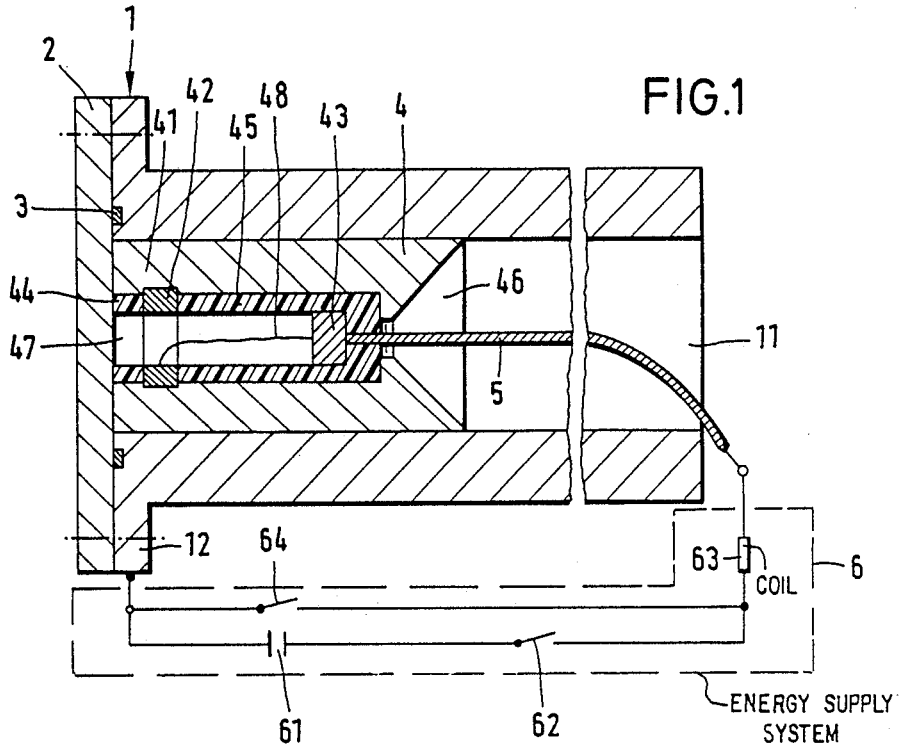
FIG. 1 is a schematic, longitudinal sectional view of a device according to the invention before an arc is generated in the projectile

In FIG. 1, a metal launching tube 1 closed at one end 12 by a breechblock 2 is preferably provided with a sealing ring 3 to better seal the closure.

A projectile 4 including a metal casing 41, an electric arc sensitive ring electrode 42, an electric arc sensitive inner electrode 43, an annular insulating member 44 and a cup-shaped insulating member 45 is disposed in tube 1. Projectile 4 is additionally provided in its front portion with respect to the direction of flight, with a bore 46 which may be funnel-shaped, and in its rear portion with a bore 47 defining a nozzle arrangement. The inner electrode 43 is electrically connected with the ring electrode 42 by means of a thin wire 48. Between the projectile 4 and the muzzle 11 of the tube 1 there is provided an insulated wire 5 whose one end is fastened to the inner electrode 43, and whose other end is connected, by way of an energy supply system 6, with the breechblock end 12.

The energy supply system 6 is composed of a capacitive voltage source 61, a switch 62 and a coil 63 connected in series, and a short-circuit switch 64 connected in parallel across the voltage source 61, switch 62 and coil 63.

The operation of the above-described device will now be described.

The acceleration process is initiated by closing of switch 62. The voltage u from voltage source 61 drives a strong current i through coil 63, wire 5, inner electrode 43, thin wire 48 and tube 1.

This causes the thin wire 48 to be heated very quickly and to evaporate in the manner of an explosion, this initiating an electric arc between inner electrode 43 and ring electrode 42.

Figure 2:
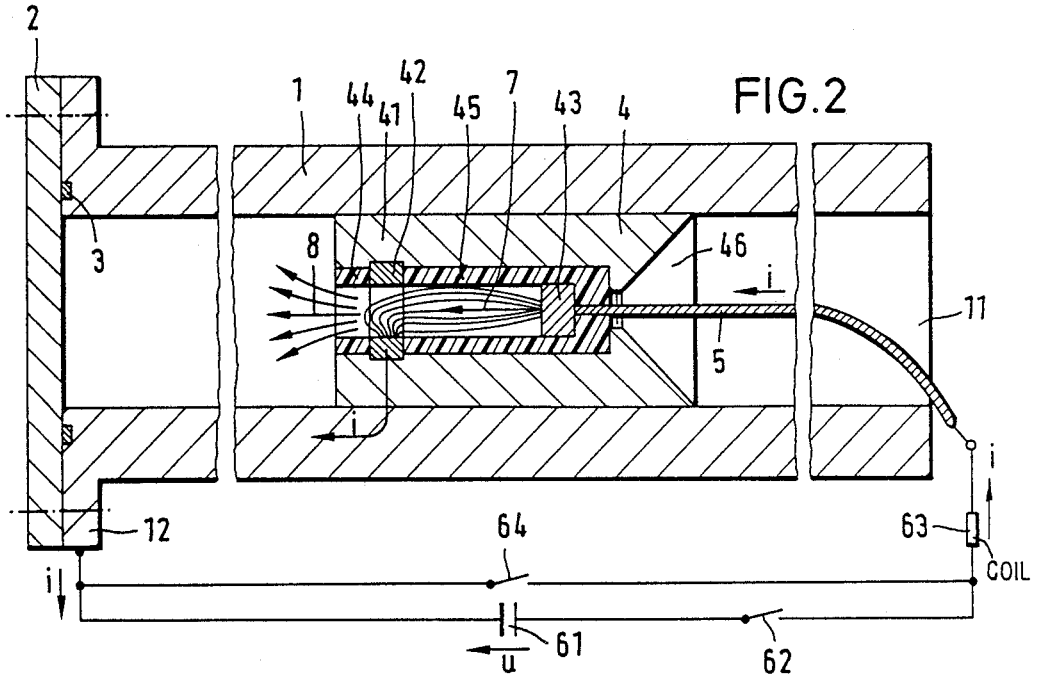
FIG. 2 shows the device of FIG. 1 after the arc has been generated in the projectile.

FIG. 2 shows the device after the arc 7 has been initiated; the arc heats a plasma 8 emanating from the bore 47 of the nozzle-shaped arrangement. The flow of the current through the arrangement is shown in FIG. 2 by corresponding arrows. The plasma heated by electric arc 7 is produced by evaporation and ablation. Electric arc 7 is generated by electric arc sensitive electrodes 43 and 42 which may be composed, for example, of aluminum or lithium. The formation and flow of the plasma is also controlled by the cup-shaped insulating member 45 as well as the annular insulating member 44. Annular insulating member 44 here prevents the formation of base points of the arc 7 in tube 1.

The outflow of the plasma 8 from projectile 4 generates a pressure which accelerates the projectile 4 in the direction of the muzzle end 11 of the tube 1. It is here ensured that the maximum possible pressure in tube 1 always occurs at the projectile 4. During the acceleration process, the wire 5 is taken up in the projectile's funnel-shaped bore 46 and is sheared off when the projectile leaves the muzzle 11 of the tube 1.

Figure 3A:
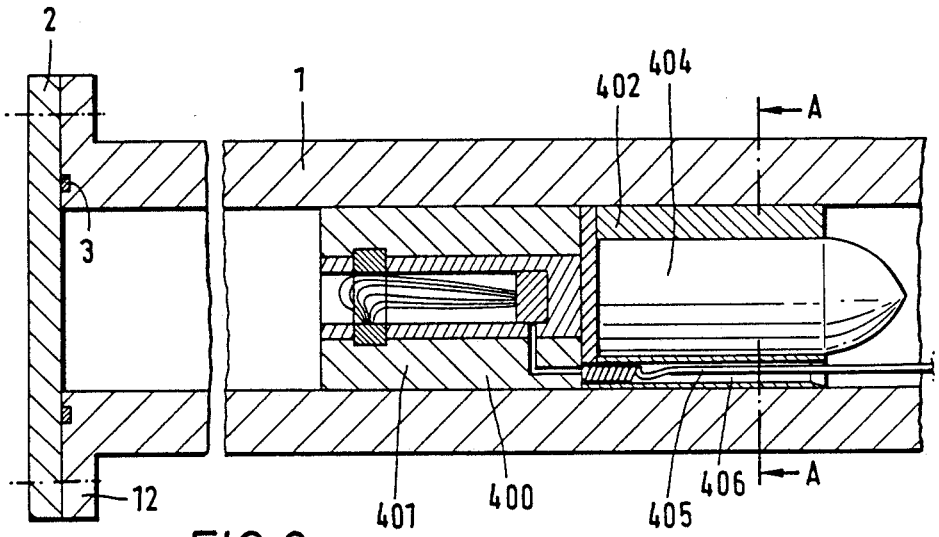
FIGS. 3*a* and 3*b* show a further embodiment of the invention.
Figure 3B:
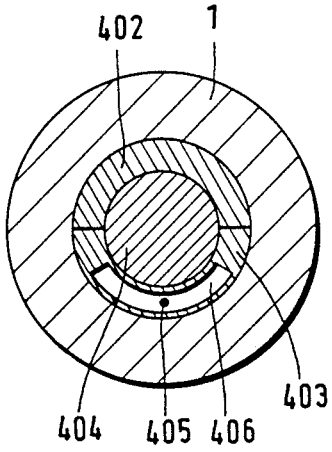

FIGS. 3*a* and 3*b* show a further embodiment of the invention in which a two part projectile includes a first projectile 400 having a driving cartridge 401 similar to that (elements 42–48) shown in FIGS. 1 and 2, which accelerates a second projectile 404 mounted in a sabot composed of first and second sabot halves 402 and 403 forward of the first projectile 400. During the acceleration process, a wire 405 is caught in a catch chamber 406 of the second sabot half 403. After leaving the muzzle of tube 1, sabot halves 402 and 403 are released from the projectile 404.

The present disclosure relates to the subject matter disclosed in the Federal Republic of Germany patent application No. P 38 14 331.3 of Apr. 28th, 1988, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. A device for accelerating a projectile, comprising:

a launching tube formed of an electrically conductive material, extending in an axial direction and having a closed first end and an open second end;

a projectile having a rear end facing said closed first end of said tube, a recess in said rear end and first and second electrodes axially spaced apart and aligned in said recess, said rear end having an opening through which said recess is in gaseous communication with said first end of said tube; and means for generating an electric arc between said first and second electrodes to heat a plasma in said recess, such that the heated plasma is able to exit said recess toward said first end of said tube into a region of said tube rearward of said projectile;

said projectile further comprising an insulating means and a metal casing which is in contact with a wall of said tube, said first electrode being ring-shaped and being disposed in a rear region of said projectile in direct electrical contact with said casing, said second electrode being disposed forward of said first electrode, said insulating means electrically insulating said second electrode from said casing, said means for generating an electric arc including an energy supply means and a first wire electrically connecting said energy supply means to said second electrode, said energy supply means being connected to said launching tube so that said first wire, said electrical supply means, said launching tube and said casing are electrically connected in series across said first and second electrodes.

2. A device as in claim 1, further comprising a second wire electrically connecting said first and second electrodes.

3. A device as in claim 2, wherein said second wire is formed of a material which evaporates in response to a large current therethrough applied by said energy supply means.

4. A device as in claim 1, wherein said generating means includes means for sustaining the electric arc throughout a movement of the projectile from an initial position in said tube to said open second end.

* * * * *